United States Patent [19]

Slattery

[11] Patent Number: 4,501,212

[45] Date of Patent: Feb. 26, 1985

[54] TUFTING MACHINES

[75] Inventor: Ian Slattery, Hixson, Tenn.

[73] Assignee: Spencer Wright Industries, Inc., Chattanooga, Tenn.

[21] Appl. No.: 550,935

[22] Filed: Nov. 14, 1983

[51] Int. Cl.[3] ..... DO5C 15/00

[52] U.S. Cl. ..... 112/266.2; 112/79 R; 112/79 A

[58] Field of Search ..... 112/79 R, 79 A, 118, 112/119, 266.2

[56] References Cited

U.S. PATENT DOCUMENTS

| | | | |
|---|---|---|---|
| 3,109,395 | 11/1963 | Batty et al. | 112/79 R |
| 3,301,205 | 1/1967 | Card | 112/79 R |
| 3,964,408 | 6/1976 | Smith | 112/79 A |
| 4,119,049 | 10/1978 | Puckett | 112/266.2 |
| 4,173,192 | 11/1979 | Schmidt et al. | 112/79 R |
| 4,224,884 | 9/1980 | Shortte | 112/79 R |
| 4,440,102 | 4/1984 | Card et al. | 112/79 R |
| 4,465,001 | 8/1984 | Ingram | 112/79 A |

*Primary Examiner*—Ronald Feldbaum

*Attorney, Agent, or Firm*—Alan Ruderman

[57] ABSTRACT

Tufting apparatus and method for producing a high density tufted fabric in a wide range of gauges and patterns. In one embodiment the needles and backing material support fingers are laterally shifted together by a common drive controlled by a cam having pattern information thereon. The needles and fingers are shifted in a first direction while the needles are outside the backing material and are thereafter shifted back toward the original position after the needles have penetrated and are within the backing material. In another embodiment the needles are shifted in accordance with a first cam operated pattern control, and the support fingers are shifted by means of a second cam actuated pattern control. Provision may be made in the common drive for adjusting the amount of lateral shift provided by a single cam and/or utilization of the same cam with machines having different gauge part spacings. An additional feature is the provision of shifting the needles in a first direction and jogging the backing material in an opposite direction to provide a high density fabric having various patterns.

20 Claims, 12 Drawing Figures

TUFTING MACHINES

BACKGROUND OF THE INVENTION

This invention relates to tufting machines and more particularly to a method and apparatus for increasing the density of the pile fabric produced even in fine gauge tufting machines, and further to a method and apparatus which permits not only the density of such fabric to be increased but patterning effects and streak break-up therein.

In the production of tufted fabrics a plurality of spaced yarn carrying needles extend transversely across the machine and are reciprocated cyclically to penetrate and insert pile into a backing material fed longitudinally beneath the needles. During each penetration of the backing material a row of pile is produced transversely across the backing. Successive penetrations result in a longitudinal row of pile produced by each needle. This basic method of tufting limits the aesthetic appearance of tufted fabrics so produced. Thus, the prior art has developed a number of procedures for initiating relative lateral movement between the backing material and the needles in order to laterally displace longitudinal rows of stitching and thereby create various pattern effects, to break up the unattractive alignment of the longitudinal rows of tufts and to reduce the affects of streaking which results from variations in coloration of the yarn.

One such procedure has been to jog or shift the needle bar transversely across the tufting machine relatively to the base material in a step-wise manner in accordance with a pattern. Exemplary of this prior art are U.S. Pat. Nos. 3,026,830; 3,964,408; 3,972,295; 4,010,700; 4,173,192; and 4,392,440.

It is also known to initiate relative movement between the backing material and the needles by jogging or shifting the needle plate, i.e., the plate over which the backing material is fed and which carries a plurality of fingers between which the needles extend during penetration. Examplary of this prior art are U.S. Pat. Nos. 3,301,205; 3,577,943; 3,934,524 and 3,964,407.

Another procedure for initiating relative lateral shifting between the needle and the backing material is by the use of what is known as a "jute shifter" wherein the gauge parts, i.e., needles etc. remain laterally stationary while the backing material alone is shifted usually by spike rollers upstream and/or downstream of the feed direction. However, when synthetic, as opposed to jute backing, was introduced, difficulties resulted since the synthetic backings are more difficult to shift than jute backings. The synthetic backings do not respond positively in every instance or uniformly to the movement of the rollers. Consequently, use of such "jute shifters" are not in favor at this time.

Another reason for initiating relative lateral movement between the needles and the backing material is to increase the density of the fabric by placing the stitches closer than the gauge of the machine, and in fact this was the main objective in a number of the aforesaid patents including U.S. Pat. Nos. 3,577,943 and 3,934,524. Another proposal for increasing the density of the pile fabrics produced by tufting was a proposal illustrated in U.S. Pat. No. 3,596,617 in which the loopers and cutting knives were proposed to be simultaneously shifted together with the needles and which was proposed at a time when relatively fine gauge tufting machines were not developed to a practical extent.

However, this mechanism itself was found to be exceptionally complex and too impractical, and thus was never used in production.

When utilizing a sliding needle bar the needle bar drive pattern and the timing of the machine is generally such that the needles are laterally shifted while they are above the needle plate so as not to contact the needle plate fingers. In the prior art, before it was practical to produce a cam having a large peripheral surface, when it was desired to have a larger pattern repeat, i.e., more stitches within each repetition of the pattern, it was necessary to instigate lateral movement of the needle bar while the needles were still in the backing material and thereafter continue the lateral movement of the needle bar while the needles were free of the backing material to compensate for the small dwell time permitted by the prior art cams. Moreover, in the aforesaid U.S. Pat. No. 3,577,943 the backing material was shifted by the needle plate during a portion of the time that the needles were within and moving downwardly through the backing material to produce a dense cut pile fabric.

It has recently been proposed to intentionally shift the needle bar while the needles are within the fabric to move the fabric slightly and thereby increase the density. Obviously, an intentional jogging of the needles while within the base material must occur without the needles engaging the needle plate fingers to prevent breakage of the needles and/or the fingers.

It should be understood that each time the needles shift laterally they must at the time of loop seizure be in cooperative relationship with a corresponding looper. Thus, by jogging back and forth a greater density of tufts occurs at certain portions of the fabric than at others and this can be specifically seen in cut/loop fabrics. Consequently, merely by timing the needle shifting to occur in this manner precludes the use of such constructions in fine gauge tufting machines, e.g., one eighth inch and smaller between the respective gauge parts, and due to variations in density in the fabrics, even some coarser gauge fabrics, such as cut/loop, may be precluded. Thus, the amount of movement of the needles if any shifting within the fabric occurs in this manner is exceptionally limited and such increase in density can only be accomplished in certain coarser gauge machines where there is sufficient space between the needle plate fingers and where patterning will not be detrimentally effected. Thus, although shifting of the needles less than a full gauge has been accomplished in coarse gauges, a practical solution to increasing the density of fine gauge tufting machine products has not heretofore been proposed.

SUMMARY OF THE INVENTION

Consequently, it is a primary object of the present invention to provide a method and apparatus for producing a very dense pile tufted fabric.

It is another object of the present invention to provide in a tufting machine a method and apparatus for producing dense pile fabric by shifting both the needles and the backing material by either a common drive means or by separate drive means.

It is a further object of the present invention to provide in a tufting machine a method and apparatus for producing lateral movement of the backing material by means of providing a shift to the needle plate fingers and the needles, the movement being less than the gauge of the tufting machine gauge parts while maintaining the needles alway substantially centered between the corresponding needle plate fingers for permitting a much wider range of shifting motions than heretofore available.

It is a still further object of the present invention to provide a method and apparatus for operating a tufting machine such taht the needle bar and the needle plate fingers are shifted laterally while maintaining the needles intermediate respective fingers so that less than full gauge shifting can occur even in fine gauge tufting machines.

It is yet a further object of the present invention to provide a method and apparatus for a tufting machine in which the needle bar and the needle plate fingers are shifted laterally together from a common pattern controlled drive while the needles are within the backing material so that the needles may be maintained intermediate respective needle plate fingers and produce less than full gauge shifting over a wide range of shifting movements.

It is still yet a further object of the present invention to provide in a tufting machine a method and apparatus in which the needle bar and the needle plate fingers are shifted laterally for maintaining the needles intermediate the respective fingers so that less than full gauge shifting can occur, the amount of laterally displacement being selectively varied.

It is further yet another object of the present invention to provide in a tufting machine a method and apparatus for increasing the density of the product produced by shifting the needle bar and the needle plate fingers to maintain the needles intermediate respective fingers and to produce pattern effects by moving the needles relatively to the needle plate fingers.

Accordingly, the present invention provides a tufting machine having apparatus, and a method of operating the tufting machine, for producing a high density tufted fabric in a wide range of gauges and patterns. To this end, in one aspect of the invention the needle bar and needle plate fingers are laterally shifted together by a common drive. The drive is controlled by a patterning device, which in the preferred embodiment is a cam, and controls the movement such that the needles are shifted or jogged on the upstroke when they are out of the backing material, and on the downstroke after they enter the backing material. The needles in this embodiment always cooperate with the same loopers, and when shifting within the backing occurs the backing material is jogged or moved from its relaxed position where it was disposed when the needles were outside the backing, however, since the needle plate fingers are jogged together with the needles, the needles are always centered between respective needle plate fingers thereby permitting a much wider range of shifting motions than can be obtained from shifting the needles between stationary needle plate fingers. Thus, shifting within the backing can occur in machines of substantially any gauge. To obtain a denser pile than the normal gauge of the machine requires alternate shifting of the needles in a first direction on one stitch and in a second direction on the subsequent stitch, the stitches which tend to pile up alternately adjacent the pair of needle plate fingers between which a needle operates in the prior art, does not occur when the fingers are shifted together with the needles—the stitches are always centered between the fingers. Consequently, the fabric so produced has uniform density across the entire width of the fabric.

Another aspect of the invention is the provision of means in the common drive which can be adjusted for driving the needle bar and needle plate for moving a different selected distance. For example, assuming that the pattern device whether a cam, a chip in the case of an electromechanical or electrohydraulic drive, etc. is constructed to provide the needle bar and needle plate with a one half gauge shift, the needle bar and needle plate will shift only that amount, and if a different amount of shift, such as one third gauge etc., is desired the pattern device would have to be changed. However, by providing the drive with mechanism that can be adjusted for selective shifts, the same pattern device can be used for providing the various shift increments. Consequently, this aspect of the invention recognizes such a need for reducing the number of pattern devices required. Moreover, the pattern device could be used with different gauge machines without necessitating an inventory of different pattern devices, e.g., cams, a single cam design thereby may be utilized with machines of a different gauge and the amount of shift adjusted by the adjustable mechanism.

A further aspect of the invention is the provision for a separate drive for the needle bar and needle plate so that they can be driven selectively together less than the full gauge while maintaining the needles centered between the needle plate fingers, or the needles may be shifted a full gauge or multiples thereof relative to the fingers thereby stepping over the fingers to cooperate with another looper to produce a pattern on the fabric. In the preferred form of this aspect of the invention the needle bar is driven by a first cam drive while the needle plate is driven by a second cam drive, the cams being such that they may drive both the needle bar and the needle plate simultaneously equal amounts, and the needle bar can also have pattern information for driving the needle bar relative to the needle plate for other selected stitches.

A further related aspect of the present invention is the provision of utilizing a jute shifter in combination with a shifting needle bar, the jute shifter providing the increase pile density while the needle bar provides the patterning and streak breaking affects. In such a case the backing material may be shifted independently of the needles while the needles are outside the backing which would preclude needle breakages due to the reaction forces of the backing, and the needles can be shifted while substantially outside the backing. This would provide wide range patterning designs in a dense pile fabric.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
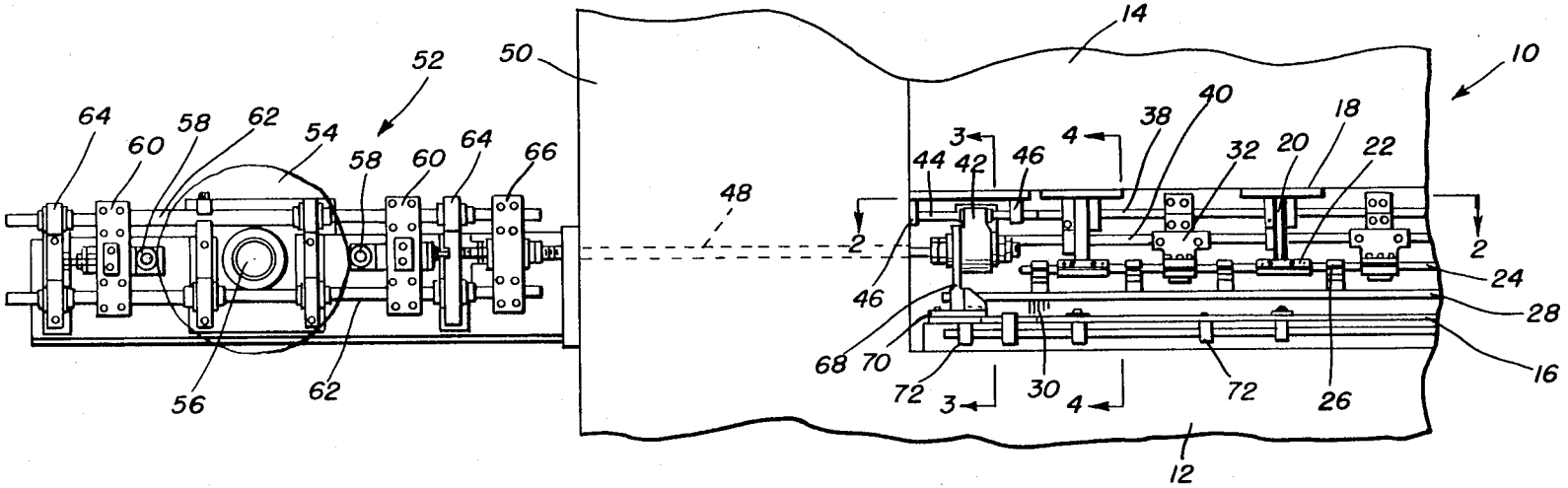
FIG. 1 is a framentary front elevational view of a tufting machine incorporating apparatus constructed in accordance with the principles of the first aspect of the present invention illustrating a common drive for shifting both the needle bar and the needle plate fingers together as a unit.
Figure 2:
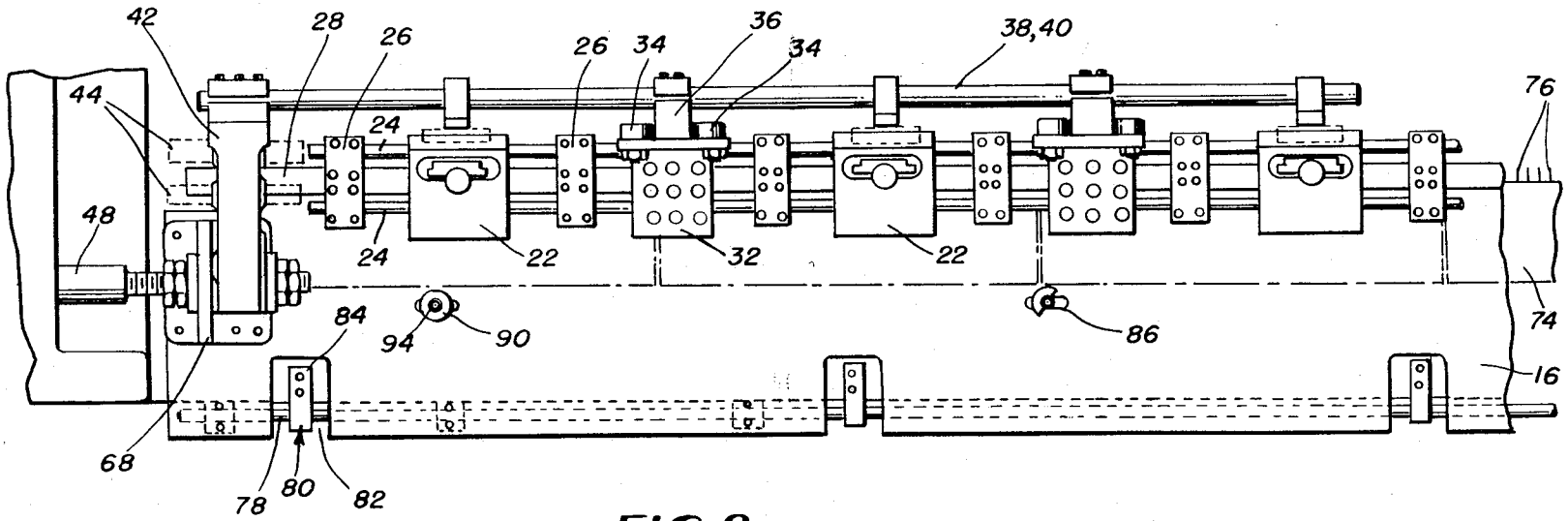
FIG. 2 is an enlarged cross-sectional view taken substantially along line 2—2 of FIG. 1.
Figure 3:
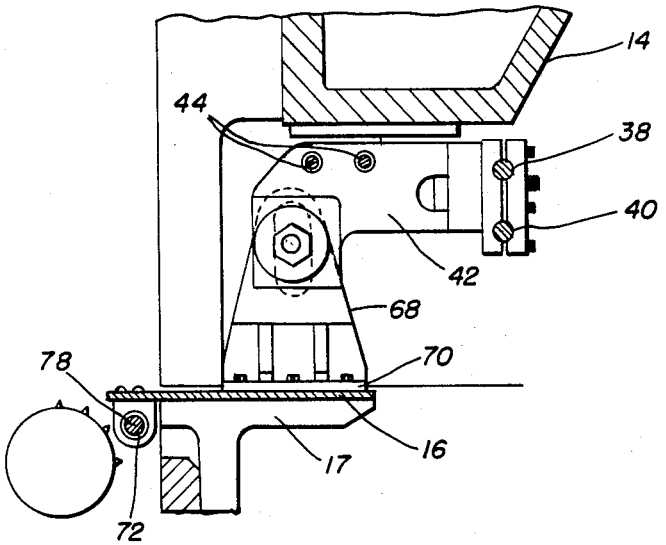
FIG. 3 is an enlarged cross-sectional view taken substantially along line 3—3 of FIG. 1.
Figure 4:
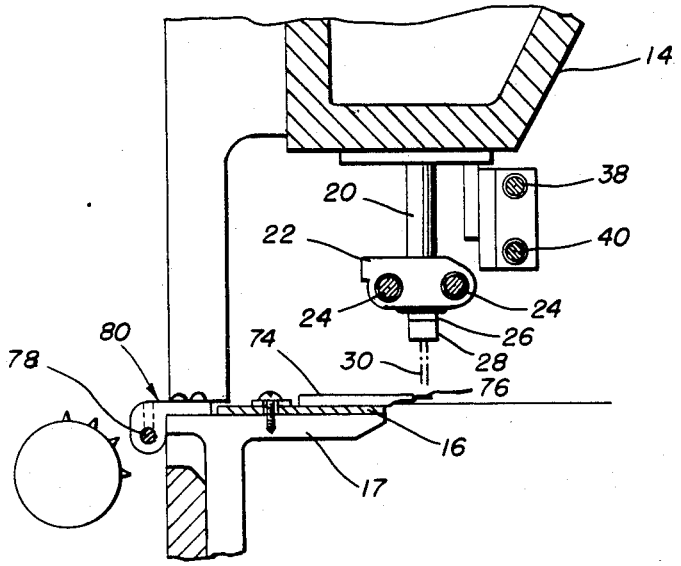
FIG. 4 is an enlarged cross-sectional view taken substantially along line 4—4 of FIG. 1.
Figure 5:
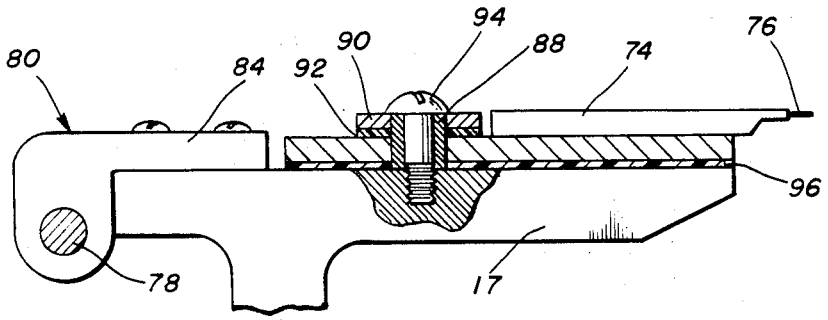
FIG. 5 is a view of a portion of FIG. 4 greatly enlarged and with parts thereof broken away.

Referring now to the drawings, FIG. 1 generally illustrates a portion of a tufting machine 1 having a frame comprising a bed 12 and a head 14 disposed above the base. The bed includes a needle plate support plate 16 disposed on a bed plate 17 over which the backing material (not illustrated) is adapted to be fed by conventional means.

Mounted in the head for vertical reciprocation within one of a plurality of bushing assemblies 18 is a respective push rod 20 to the lower end of which a clamping foot 22 is carried. The clamping foot 22 includes a pair of linear bearings within which a pair of slide rods 24 are slidably disposed. The rods 24 are secured to a plurality of bracket members 26 which in turn are secured to a needle bar 28 which carries a plurality of needles 30. The needle bar and thus the needles are slidable laterally relative to the support feet 22 and are reciprocably driven vertically by the action of the push rods. Upon reciprocation of the push rods the needles cyclically penetrate the backing material to project loops of yarn therethrough as the push rods are reciprocated by conventional means. The needles cooperate with loopers (illustrated only in FIG. 6) mounted beneath the needle plate support plate in the bed for seizing the loops of yarn presented by the needles and for releasing the loops to form loop pile and for holding the loops until cut by a knife cooperating with the loopers or hooks as is notoriously well known in the tufting art to produce cut pile.

To drive the needle bar selectively with controlled lateral movement a bracket 32 is clamped to the slide rods 24, the bracket 32 carrying a pair of spaced rollers 34 rotatable about a respective substantially horizontal axis. Each pair of rollers 34 straddles and is guided by a hardened block 36 which is clamped to a pair of drive rods 38, 40. At one end of the head 14 of the tufting machine the rods 38 and 40 are clamped to a needle bar drive bracket 42. The bracket 42 is supported by bearings guided for lateral sliding movement on a pair of short support or stud shaft 44 carried by lugs 46 depending from the head 14. The bracket 42 is secured to a drive rod 48 which is journalled in and extends through the end housing 50 of the tufting machine head 14 toward a pattern control shifting apparatus generally indicated at 52.

Although any pattern controlled shifting apparatus including mechanical, electromechanical, hydromechanical, pneumaticmechanical, etc. may be utilized in accordance with the present invention, it is preferred to utilize the shifting apparatus 52 which forms the subject matter of and is described fully in copending U.S. patent application Ser. No. 480,244 filed Mar. 30, 1983, and assigned to the common assignee of the present invention. For a complete description of that apparatus reference may be had to the aforesaid patent application, but in general this shifting apparatus includes a pattern cam 54 mounted on a shaft 56 driven in timed relationship to the reciprocation of the needle bar 28. The periphery of the cam 54 acts againt a pair of followers 58 which are each supported on a respective block 60 clamped to slide rods 62 which are slidably carried in bearing blocks 64. The rods 62 are also clamped to a block 66 to which the drive rod 48 is fastened. Consequently, as the cam 54 rotates it drives the followers 58 together with the blocks 60 and thus the rod 62, and since the block 66 is connected to both the slide rod 62 and the needle bar drive rod 48, this latter drive rod is driven laterally as controlled by the cam 54. The movement of the needle drive rod 48 is transmitted to the bracket 42 which in turn drives the rods 38 and 40. The rods 38 and 40 drive the block 36 which not only permits the rollers 34 to roll vertically against the surface thereof as the push rods reciprocate, but also laterally drives the rollers 34. Since the rollers 34 are carried by the bracket 32 which is clamped to the slide rods 24, lateral movement of the rods 38 and 40 is transmitted to the needle bar 28 by the brackets 26 fastened to the rods 34 and to the needle bar. Consequently, the cam 54 drives the needle bar laterally according to the pattern information thereon.

In accordance with the present invention in addition to the needle bar driven bracket 42 the drive rod 48 also carries a needle plate finger drive bracket 68 which is secured thereto and extends downwardly from adjacent the needle bar drive bracket 42. The needle bar drive bracket carries a plate 70 at its lower end which is secured to the needle plate support plate 16. A plurality of abutting needle plates 74 having spaced needle plate fingers 76 are secured to the upper surface of the needle plate support plate 16 adjacent a laterally extending edge beneath the needles, and a plurality of lugs 72 are secured to the needle plate support plate 16 at spaced locations adjacent the edge remote from the fingers 76. A shaft 78 is journalled in bearings in the lugs 72 and is secured to a plurality of spaced clamping brackets 80 disposed in open slots 82 formed in the needle plate support plate 16, the brackets 80 having a portion 84 extending toward the closed end of each slot 82 and are fixed to the bed plate 17. Thus the needle plate support plate 16 together with the needle plates 74 and the fingers 76 carried thereon may be moved relatively to the bed plate 17 as the needle plate drive bracket 68 is moved by the drive rod 48. Consequently, the fingers 76 move together laterally with the needles 30 and the needles will always remain centered between a respective pair of fingers 76.

To support the needle plate support plate 16 on the fixed bed plate rail 17 and yet permit it to move relative thereto while precluding upward pivoting of the needle plate support plate about the shaft 78, a laterally elongated slot 86 is formed in the needle plate support plate at spaced locations for receiving a cylindrical bushing 88. The bushing 88 extends through the slot 86 so that the bottom of the bushing abuts the bed plate 17, the bushing being of a length such that the top of the bushing extends above the surface of the needle plate support plate 16. A washer 90 having a low friction bearing tape 92 such as that sold under the trademark RULON attached to the bottom thereof is positioned about the periphery of the bushing where it extends above the needle plate support plate and a screw 94 extends through the washer and bushing and is threaded into the bed plate 17, the head of the screw 94 acting against the washer and the bushing to force the washer and bushing downwardly against the bed plate 17. The low friction bearing tape permits the needle plate support plate to slide relatively to the washer with little friction. Additional low friction bearing tape 96 is fastened to either the top of the bed plate 17 or the lower surface of the needle plate support plate 16 so that the needle plate support plate may slide with little friction on the bed plate. With this construction the washer 90 acts against the top surface of the needle plate support plate and prevents the needle plate support plate from lifting and pivoting about the shaft 78, yet the needle plate support plate is permitted to slide readily relatively to the bed plate. The slot 86 is elongated laterally a distance at least equal to the maximum amount of shift of the needle plate fingers, which distance is less than the gauge of the tufting machine, i.e., less than the space between two needle plate fingers 76.

The operation of a tufting machine incorporating apparatus constructed in accordance with the principles of the invention will now be described with reference to FIGS. *6a* through *6d*, and described with regard to the operative cycle of the needle 30. In FIG. *6a* a needle 30 has shed its loop and is ascending. Since the loop shedding and seizing operation is the same as that of a conventional tufting machine the yarn and loops thereof are, for reasons of clarity of presentation, not illustrated. However, it can be seen that the needle is elevated above and in line with its normal disposition at loop seizure with the corresponding looper 100 and substantially centered between the needle plate fingers 76. Once the needle has ascended above the fingers 76, the needle 30 is shifted off-gauge by means of the needle shifting apparatus to the position illustrated in FIG. *6b*. This lateral shift occurs while the needle is above the backing material illustrated at 102, and when the needle again penetrates the backing material on the downstroke, as illustrated in FIG. *6c*, the needle 30 is still off-gauge from the looper 100 but begins to shift to the on-gauge position. The needle thereafter continues to shift back on-gauge prior to cooperation with the looper for loop seizing and shedding, such position being illustrated in FIG. *6d*. Since the needle and the fingers shift between the positions illustrated in FIGS. *6c* and *6d*, the backing material is jogged less than a full gauge of the machine prior to loop seizure by the looper. In the prior art the shifting of the needle occurred without a corresponding shift of the fingers 76 which were fixed. Thus, since the fingers are spaced apart by an amount equal to the gauge of the machine, the amount of needle movement is limited to prevent contact with the needle plate fingers, and this process could only be used with coarse gauge machines. However, with the present invention, the shifting apparatus moves the fingers 76 together with the needles and as illustrated in FIGS. *6a–6d* the needles are always in the same position relative to the fingers, i.e., substantially centered therebetween. Consequently, a jogging of the base material may be performed even in fine gauge tufting machines. In other words, the restrictions imposed by small gauge machines in the jogging of the base material is now overcome by the present invention, and the density of the pile fabric produced by fine gauge tufting machines may be increased.

Figure 7:
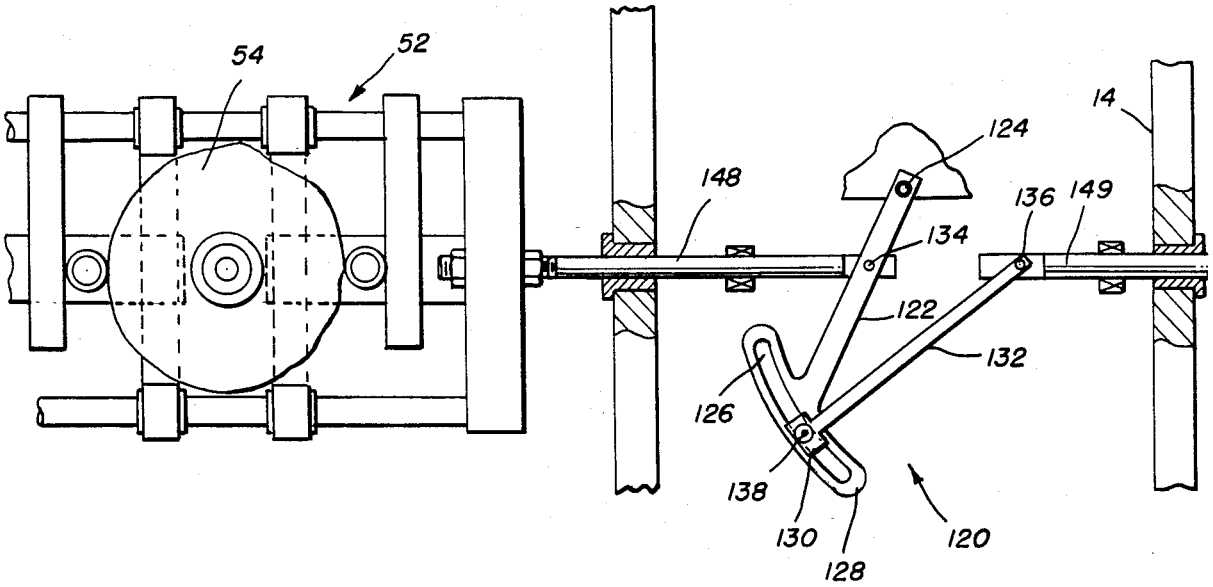
FIG. 7 is a front elevational view illustrating in diagrammatic form a shift distance selection mechanism.
Figure 6A:
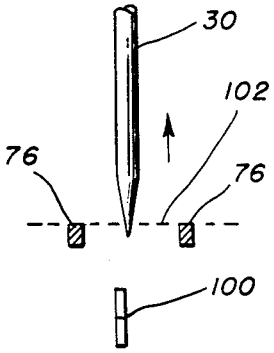
FIGS. 6*a* through 6*d* depict in a diagrammatic form the disposition of the needles, loopers and needle plate fingers at different positions of the cycle in carrying out the method of the invention.
Figure 6B:
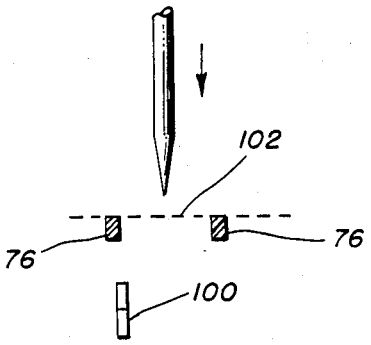
Figure 6C:
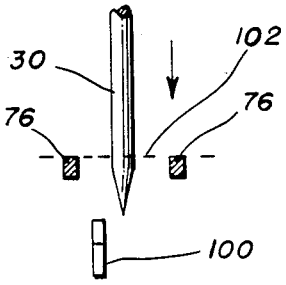
Figure 6D:
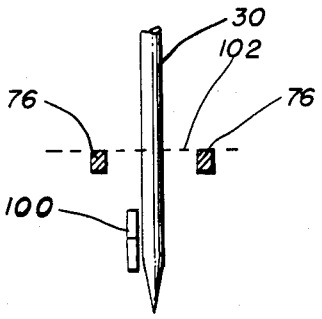

Furthermore, with the present invention it is possible to select the degree or amount of shift made by the needles and fingers to a selective amount less than a full gauge. Normally only one half shift is desired. However, in some situations more or less of a shift may be desirable yet still be less than the full gauge using the same pattern device, e.g., cams etc. Moreover, it is desirable to reduce the number of pattern devices so that the same pattern device may be used for machines of different gauges. To this end another aspect of the present invention is the provision of a shift variation device 120 illustrated in FIG. 7. Such device may be inserted into the shifting apparatus between the shifting apparatus 52 and the drive shaft 48. Thus, the shift variation device may comprise a first lever 122 having one end pivoted at 124 to a fixed portion of the tufting machine or to the shifting apparatus and has an elongated slot 126 formed in another end 128 which is constructed for receiving the slot. The slot 124 has an arcuate shape and receives a slide block 130 which is pivoted to one end of an arm 132. The lever 122 is pivotably connected at 134 to a drive rod 148 while the other end of the arm 132 is pivotably connected to a drive rod 149, the rods 148 and 149 effectively being similar to the drive rod 48 illustrated in FIG. 1 split for insertion of the device 120. The arc of the slot 126 is a radial arc of the arm 132 about the pivot 136 so that by securing the slide block 130 at selective locations within the slot, the amount of shift imparted from the rod 148 to the rod 149 may be varied. The block 130 may be fastened to a shift variation selector 138 which can be controlled from a convenient location. Thus, when utilizing a single cam 54 the amount which the needle bar and needle plate support plate is shifted may be varied selectively utilizing the same pattern cam.

Figure 8:
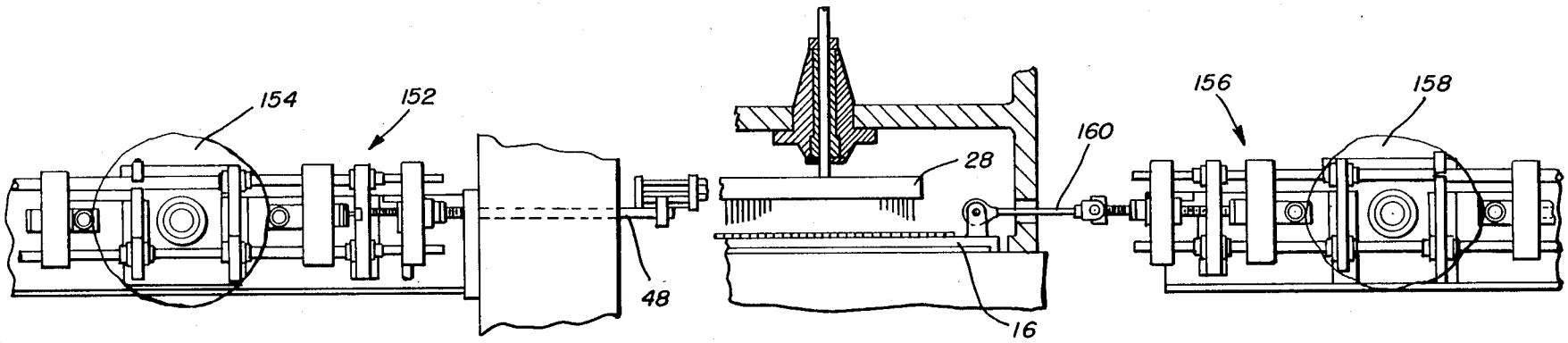
FIG. 8 is a view similar to FIG. 1 illustrating a second embodiment of the invention.

In another aspect of the invention the needle bar and the needle plate fingers may be shifted by separate shifting apparatus so that the needles and fingers may be shifted simultaneously together for less than a full gauge shift for density increasing purposes while maintaining the needles centered between the fingers and yet the needles may be shifted periodically at least a full gauge for placing a pattern in the fabric product. Thus, as illustrated in FIG. 8 a first shifting apparatus 152 having a first pattern cam 154 may be used to drive a first drive rod 148 operably connected to the needle bar 28 to slidably drive the needle bar and the needles 30 in a manner as heretofore described, and a second shifter 156 having a second cam 158 may drive a second drive rod 160 operably connected to the needle plate support plate 16 to shift the needle plate support plate and the needle fingers. The cams 154 and 158 are cut such that both move their respective followers and the needle bar and fingers respectively simultaneously the same amount less than full gauge such that the needles are always centered between the fingers. However, periodically as desired by the pattern, the cam 154 has increased lobes thereon for shifting the needle bar a full gauge or multiple thereof while the cam 158 provides no shift at all and its followers are at a dwell condition. Consequently, each needle steps over a respective finger as determined by the pattern at certain stitches, while during the remainder of the pattern the needles and fingers shift less than full gauge together so that a high density fabric having a pattern thereon is provided. Alternatively, the cam 154 may have a pattern which provides a needle shift of a full gauge or multiple thereof plus or minus a fraction of the gauge while the cam 158 would then have a pattern providing a shift of the fingers in the amount of that fraction of the gauge.

Figure 9:
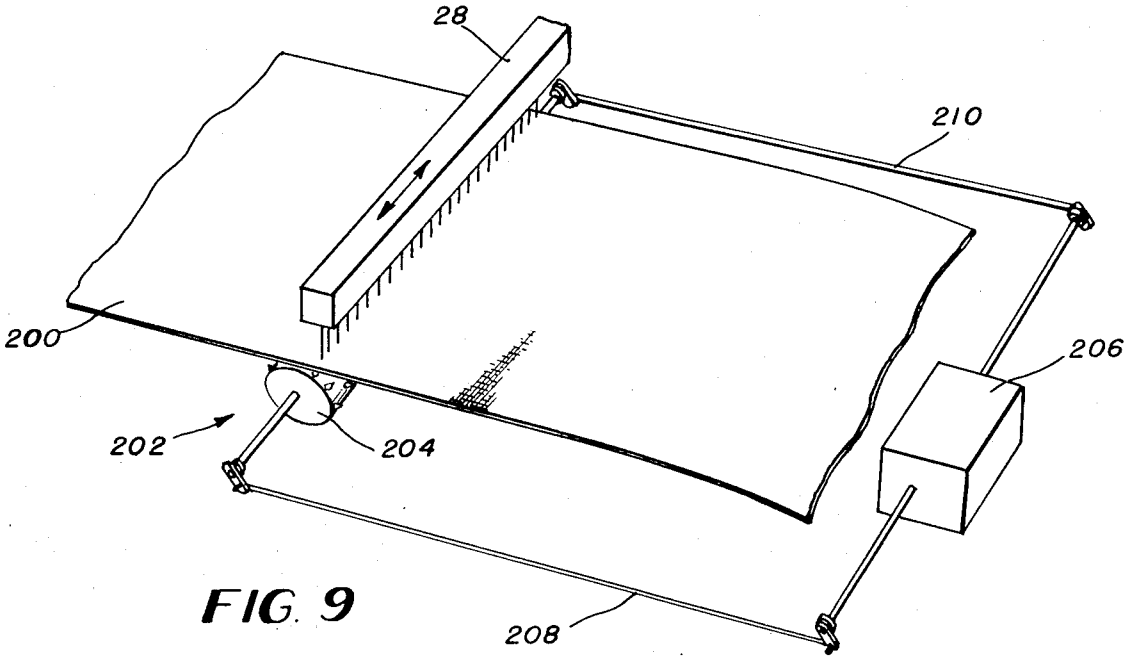
FIG. 9 is a diagrammatic perspective view of another embodiment of the invention.

Additionally a related aspect of the present invention is illustrated in FIG. 9 wherein the needle bar 28 is shifted by shifting apparatus such as described above, and the backing material 200 is jogged by a jute shifter illustrated generally at 202. The jute shifter may comprise one or more spiked rollers 204, upstream, downstream or at both locations and driven by shifting apparatus illustrated generally at 206 for laterally moving arms 208, 210 which support the rollers 204. Preferably the backing material is shifted in opposition to the needle bar so that as the needles move to the right the backing material moves to the left and vice versa. In that case the needles would be shifted a full gauge or multiple thereof, while the backing material would be shifted in a jogging manner less than a full gauge. In this manner a high density fabric can be produced by apparatus having a simplified construction. However, if found desirable the needle bar may be shifted together with the fingers and in addition the jute shifter may be used. If should be understood that in FIG. 9 the backing material is supported by needle plate fingers which, for purposes of clarity of presentation, have been omitted from the figure.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of tufting pile fabric comprising, feeding a backing material in one direction, reciprocably penetrating a plurality of needles through said backing material from one side thereof, said needles being spaced apart transversely to said feed direction, supporting said material during needle penetration thereof by a plurality of fingers spaced apart in the same direction as said needles, the spacing between adjacent fingers being substantially the same as the spacing between adjacent needles, shifting said needles and said fingers in synchronism from a first position transversely to said one direction while said needles are on one side of said material, penetrating said material with said needles, and shifting said needles and said fingers in synchronism to said first position while said needles are within the backing material.

2. A method as recited in claim 1, wherein said needles and fingers are shifted in unision in accordance with a pattern.

3. A method as recited in claim 2, including shifting said needles periodically while on said one side independently of said fingers.

4. A method as recited in claim 1, wherein the amount of shift in each direction is less than the spacing between adjacent needles.

5. The method as recited in claim 4, wherein the amount of shift in each direction may be selectively varied.

6. A method of tufting pile fabric comprising, feeding a backing material in one direction, reciprocably penetrating a plurality of needles through said material from one side thereof, said needles being spaced apart transversely to said feed direction, supporting said material during needle penetration thereof by a plurality of fingers spaced apart in the same direction as said needles, the spacing between adjacent fingers being substantially the same as the spacing between adjacent needles, shifting said needles transversely to said first direction while said needles are on said one side of said material, and shifting said base material in a direction oppositely to said needles an amount less than said needles are shifted.

7. In the method as recited in claim 6, wherein said needles are shifted at least equal to a multiple of the spacing between the adjacent needles, and said base material is shifted a distance less than the spacing between adjacent fingers.

8. In a tufting machine, means for feeding a base material in one direction, a plurality of yarn carrying needles spaced apart transversely to said one direction, means for reciprocating said needles to penetrate the base material and to form loops therein, means for mounting said needles for movement in a direction transverse to said one direction, a needle plate including a plurality of transversely spaced fingers for supporting said base material, said fingers being spaced apart a distance substantially equal to the spacing between said needles, pattern control means for shifting said needles and said fingers in synchronism from a first direction while said needles are outside said base material and for shifting said needles and fingers in synchronism back to said first position while said needles are within said base material.

9. In a tufting machine as recited in claim 8, wherein said pattern control means includes drive means transversely moved in accordance with a pattern, and means for connecting said drive means to said needles and said needle plate to shift said needles and fingers in unison.

10. In a tufting machine as recited in claim 9, wherein said drive means includes means for selectively varying the distance said needles and said fingers are shifted to and from said first position.

11. In a tufting machine as recited in claim 8, wherein said pattern control means includes first drive means transversely moved in accordance with a pattern for driving said needles, and second drive means transversely moved in accordance with a pattern for driving said fingers.

12. In a tufting machine as recited in claim 8, wherein said needles are carried by a transversely extending needle bar, said means for reciprocating said needles comprises a plurality of reciprocably driven push rods, said means for mounting said needles comprises means for drivingly connecting said needle bar to said push rods and permitting said needle bar to slide relatively to said push rods, said pattern control means comprising drive means moved transversely in accordance with a pattern, and means for connecting said drive means to said needle bar.

13. In a tufting machine as recited in claim 12, wherein said tufting machine includes a fixed bed plate spaced below said push rods, a needle plate support plate slidably disposed on said bed plate, means for securing said needle plate to said needle plate support plate, and wherein said pattern control means includes means for connecting said drive means to said needle plate support plate.

14. In a tufting machine as recited in claim 13, wherein low friction bearing tape is disposed intermediate said bed plate and said needle plate support plate.

15. In a tufting machine as recited in claim 14, including fastening means for securing said needle plate support plate to said bed plate from lifting off said bearing tape while permitting said needle plate support plate to slide relatively to said bed plate.

16. In a tufting machine as recited in claim 8, wherein said pattern control means comprises a peripheral cam rotatably driven in timed relationship to the reciprocation of said needles, follower means, drive means supporting said follower means in engagement with the periphery of said cam and constrained for transverse movement, and means for connecting said drive means to said needles and said needle plate.

17. In a tufting machine as recited in claim 8, wherein said pattern control means comprises a first peripheral cam rotatably driven in timed relationship to the reciprocation of said needles, first follower means, first drive means supporting said first follower means in engagement with the periphery of said cam and constrained for transverse movement, means for connecting said first drive means to said needles, a second peripheral cam rotatably driven in timed relationship to the reciprocation of said needles, second follower means, second drive means supporting said second follower means in engagement with the periphery of said second cam and constrained for transverse movement, and means for connecting said second drive means to said needle plate.

18. In a tufting machine as recited in claim 16, wherein said needles are carried by a transversely extending needle bar, said means for reciprocating said needles comprises a plurality of reciprocably driven push rods, said means for mounting said needles comprises means for drivingly connecting said needle bar to said push rods and permitting said needle bar to slide relatively to said push rods, said pattern control means comprising drive means moved transversely in accordance with a pattern, and means for connecting said drive means to said needle bar.

19. In a tufting machine as recited in claim 18, wherein said tufting machine includes a fixed bed spaced below said push rods, a needle plate support plate slidably disposed on said bed plate, means for securing said needle plate to said needle plate support plate, and wherein said pattern control means includes means for connecting said drive means to said needle plate support plate.

20. In a tufting machine, means for feeding a base material in one direction, a plurality of yarn carrying needles spaced apart transversely to said one direction, means for reciprocating said needles to penetrate the base and to form loops therein, means for mounting said needles for movement in a direction transverse to said one direction, a needle plate including a plurality of transversely spaced fingers for supporting said base material, said fingers being spaced apart a distance substantially equal to the spacing between said needles, pattern control means for shifting said needles transversely to said first direction while said needles are outside said base material a distance at least equal to a multiple of the spacing between adjacent fingers, and pattern control means for shifting said base material in a direction oppositely to said needles an amount less than the spacing between adjacent fingers.

* * * * *